US006926159B1

(12) United States Patent
Cash et al.

(10) Patent No.: US 6,926,159 B1
(45) Date of Patent: Aug. 9, 2005

(54) LOCKING DEVICE FOR PEG-BOARD HOOKS

(76) Inventors: Michael J. Cash, 7273 Turner Fish Rd., Willow Springs, NC (US) 27592; James A. Buffaloe, 7926 Fayetteville Rd., Raleigh, NC (US) 27603

( * ) Notice: Subject to any disclaimer, the term of this patent is extended or adjusted under 35 U.S.C. 154(b) by 1 day.

(21) Appl. No.: 10/637,183

(22) Filed: Aug. 8, 2003

Related U.S. Application Data

(63) Continuation-in-part of application No. 10/326,939, filed on Dec. 23, 2002, now Pat. No. 6,681,940.

(51) Int. Cl.[7] ..... B42F 1/00
(52) U.S. Cl. ..... 211/57.1
(58) Field of Search ..... 211/70.6, 54.1, 211/59.1, 57.1

(56) References Cited

U.S. PATENT DOCUMENTS 4,699,278 A * 10/1987 Klein ..... 211/57.1
4,869,376 A * 9/1989 Valiulis et al. ..... 211/59.1
5,485,929 A * 1/1996 Danon ..... 211/57.1
5,597,150 A * 1/1997 Stein et al. ..... 248/551
6,612,448 B2 * 9/2003 Plutsky ..... 211/43

* cited by examiner

*Primary Examiner*—Peter M. Cuomo
*Assistant Examiner*—Sarah Purol
(74) *Attorney, Agent, or Firm*—Mills Law Firm PLLC

(57) ABSTRACT

A double arm peg board support hook includes a pivoting lock bar that establishes a detent locked condition across the free ends of the hook support arms to prevent inadvertent dislodgement of articles stored thereon.

4 Claims, 5 Drawing Sheets

LOCKING DEVICE FOR PEG-BOARD HOOKS

This application is a continuation-in-part of U.S. Ser. No. 10/326,939, filed Dec. 23, 2002, now U.S. Pat. No. 6,681, 940.

FIELD OF THE INVENTION

The present invention relates to storage hooks and, in particular, to a locking device for retaining equipment on cantilevered peg-board type hooks.

BACKGROUND OF THE INVENTION

Various tools and equipment are required for the maintenance and landscaping of a household and grounds. Many are elongated and bulky and pose difficulties in storage within a garage or utility enclosure. One common type of storage uses peg-board hooks that attach to wall mounted peg boards. While the foregoing approaches provide for adequate organization and storage, a multiplicity of tools requires considerable lineal space, which is not always available. An improved tool storage using such hooks is disclosed in our pending patent application, U.S. Ser. No. 10/326,939 filed on Dec. 23, 2002 and entitled "Tool Organizer". Therein, double arm cantilevered peg-board hooks are attached to folding arms for more compactly storing the support tools.

The double arm hooks provide convenient support for most tools and related articles. If inadvertently impacted, however, it is possible for the tool to be dislodged from the support arms and fall from the hook. Inasmuch as many tool have sharp projections and considerable weight, such dislodging can pose safety risks to those in the surrounding area, particularly to children.

Accordingly, it is an object of the present invention to provide a peg-board support hook having a locking device that prevents a supported article from dislodging and falling.

Another object is to provide a peg-board hook having a locking device that is readily incorporated on existing hook designs. A further object is to provide a locking device for peg-board hooks that resists inadvertent movement from the latched condition.

SUMMARY OF THE INVENTION

The foregoing objects are accomplished by a double arm peg-board type support hook having a lock bar pivotally supported on one arm and rotatable to a locked detented position with the other arm to capture the article carried on the hook and prevent inadvertent dislodging and falling thereof. The lock bar comprises a rectangular plate having a hole for journaling one support arm and a downwardly opening slot at the other end that receives the other support arm thereby blocking the hook access slot and preventing dislodgement of the carried article. The lock bar slot is outwardly inclined and provides a detent that resists inadvertent movement of the lock bar from the latched condition. The lock bar is readily assembled by insertion over the free end of one arm. Thereafter, the free end is swaged to form outwardly extending tabs that maintain operative position and prevent removal.

DESCRIPTION OF THE DRAWINGS

The above and other objects and advantages of the present invention will become apparent upon reading the following detailed description taken in conjunction with the accompanying drawings in which.

DETAILED DESCRIPTION OF THE PREFERRED EMBODIMENTS

Figure 1:
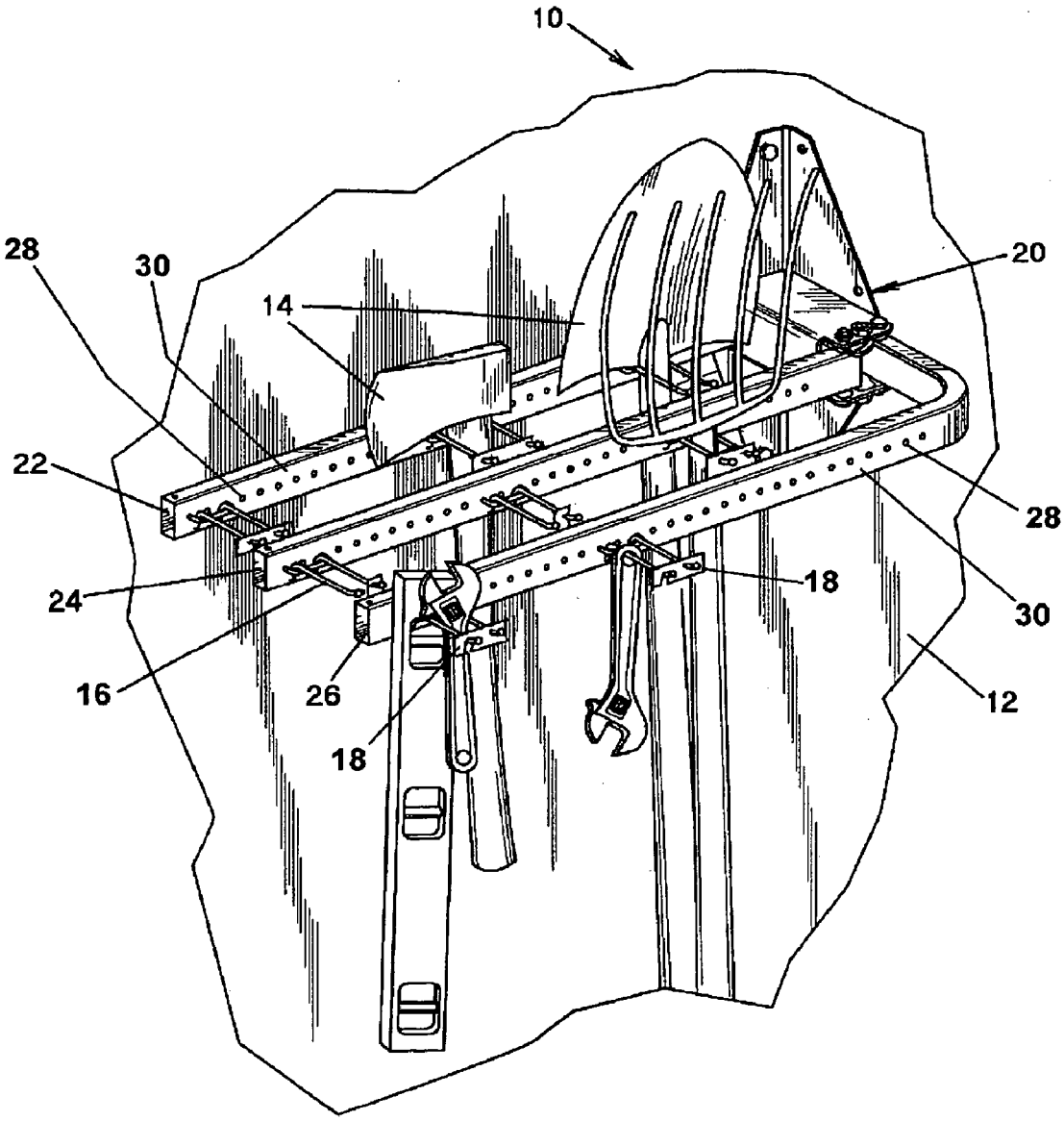
FIG. 1 is a perspective view of a tool rack organizer having tools carried on support hooks provided locking bars in accordance with one embodiment of the invention.

Referring to FIG. 1, there is shown a tool rack organizer 10 mounted on a vertical support surface 12, such as a garage or storage wall, and supporting and organizing various articles 14 on peg-board type support hooks 16 having rotatable lock bars 18 for preventing dislodging of the articles 14. The organizer typically carries thereon articles such as lawn and garden implement, tools and the like. The organizer 10 is preferably of the type disclosed in our pending application, U.S. Ser. No. 10/326,939, filed on Dec. 23, 2002 and entitled "Tool Organizer". As will be apparent, the support hooks and lock bars may also be used in conjunction with other applications for the hooks.

The organizer 10 includes a support bracket assembly 20 supporting a rear arm 22, a middle arm 24 and a front arm 26 aligned in horizontal rows parallel to the surface 12. Each of the arms 22, 24, 26 is provided with a plurality of uniformly longitudinally spaced holes 28 on A front wall 30. For the tool bar application, the holes are in a longitudinal series with 1 inch on-center spacing. The hooks are attached at 2 inch spans.

The support hooks 16 are of a type widely commercially available in varying forms. These hooks are generally characterized by a pair of hooked legs that are inserted through the mounting holes and have upwardly extending ends that engage the rear surface of the mounting substrate, a pair of downwardly extending legs that engage the front surface of the mounting substrate, and a pair of spaced forwardly extending cantilevered support arms that provide a frontally opening slot for receiving the lower portion of the stored article, with the weight of the article applied at the supports arms. The weight of the hooks and carried articles apply a torque to the hooks effecting a secure compressive engagement between opposed walls of the mounting surface, all in a well-known manner.

Figure 5:
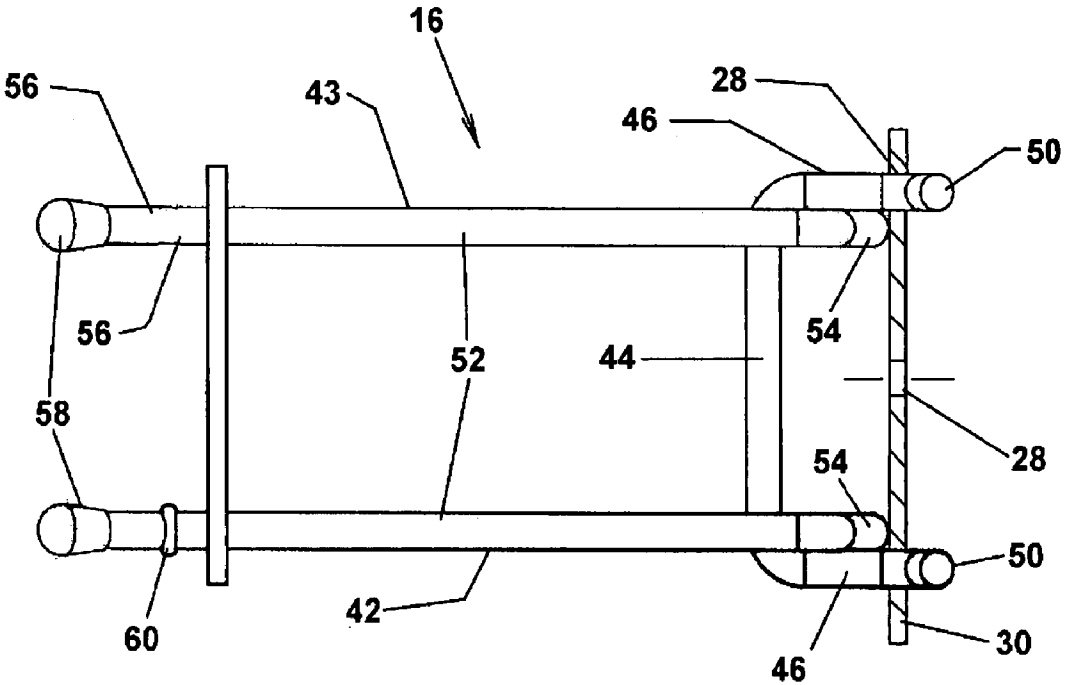
FIG. 5 is a top view of the support hook with the lock bar in the closed position.
Figure 4:
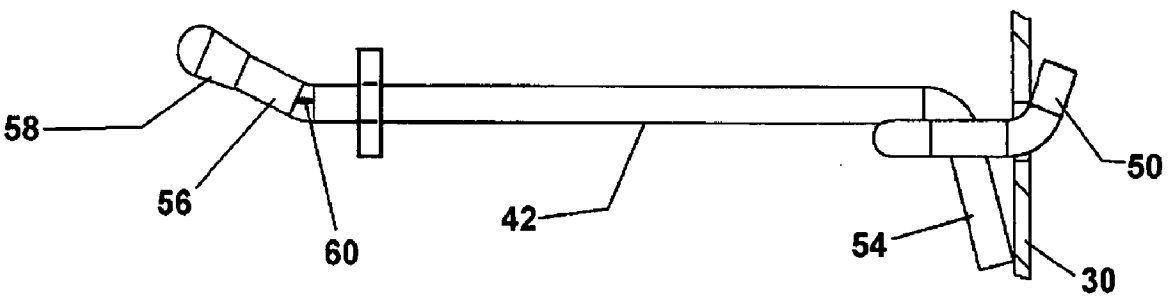
FIG. 4 is a side view of the support hook with the lock bar in the closed position.

Referring to FIGS. 4 and 5, the hook 16 for use with the present invention comprises an assembly comprising a hook mounting base 40 and a pair of spaced support arms 42. The assembly is formed of heavy gage wire.

The base 40 is generally U-shaped and includes a horizontal center rod 44 having reversely extending legs 46 at the ends thereof. The legs are laterally spaced to register with selected holes on front wall, preferably 2 inch on-center for the tool organizer. The legs 46 extend through the hole 28 and terminate with upwardly extending ends 50 that engages the rear surface of the front wall 30. Each support arm 42 includes a horizontal support rod 52 rearwardly terminating with a downwardly turned leg 54 that engages the front surface of the front wall 30 below the holes 28 and an upwardly inclined free end 56 terminating with a rounded protective plastic tip 58. Outwardly swaged tabs 60 are formed in one of the support arms at the transition between the rod 52 and the end 56. The tabs 60 are formed after assembly of the lock bar 18 and serve to prevent forward movement and removal thereof.

Figure 6:
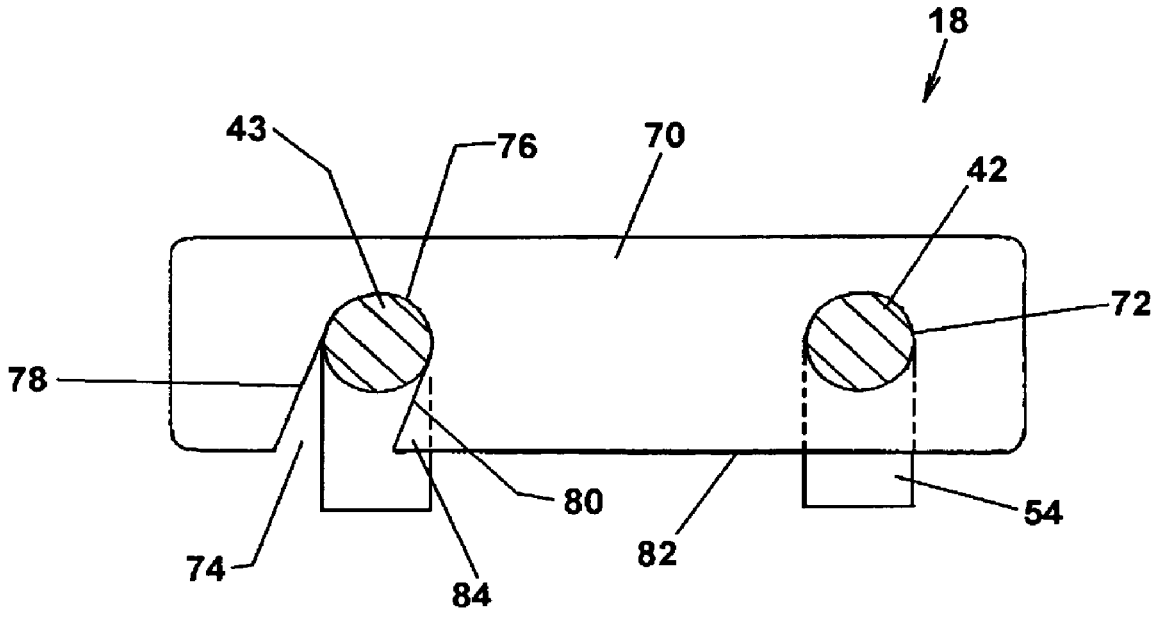
FIG. 6 is a front view taken along line 6—6 in FIG. 5 showing the lock bar in the closed position.

Referring to FIG. 6, the lock bar 18 comprises generally rectangular body 70. The body 70 has a mounting hole 72 at one end and a downwardly opening slot 74 at the other end. The support arm 42 extends through he mounting hole 72 is rotatably supported thereat with a sliding clearance fit. The slot 72 includes a hemispherical base 76 tangentially merging with downwardly and outwardly inclined, spaced sidewalls 78, 80. The axes of the hole 72 and base 74 are laterally spaced such that in the illustrated closed locked position, the base 76 registers with and engages the other support arm 43.

Figure 2:
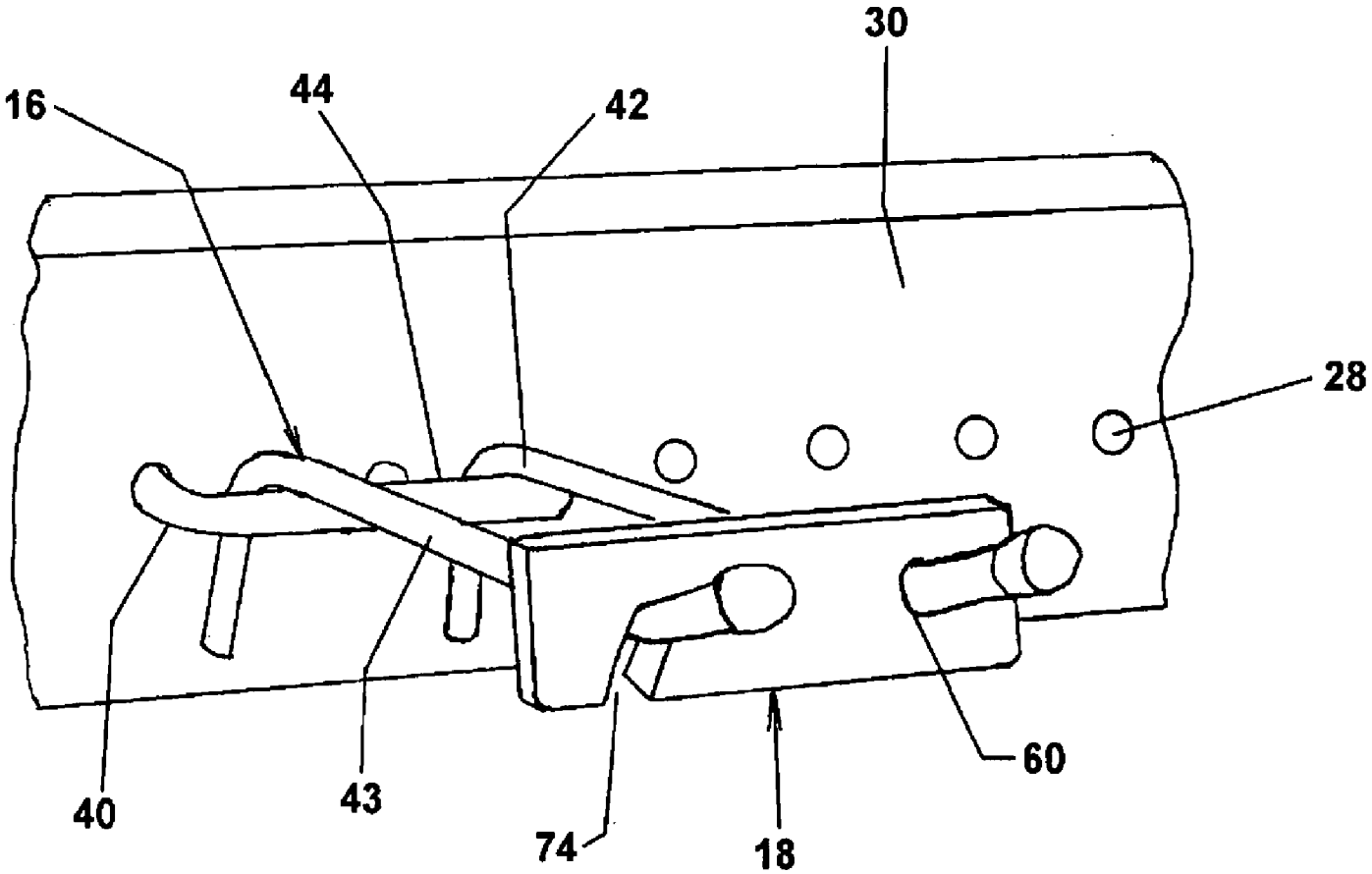
FIG. 2 is a front perspective view of the support hook with the lock bar in the closed position.
Figure 3:
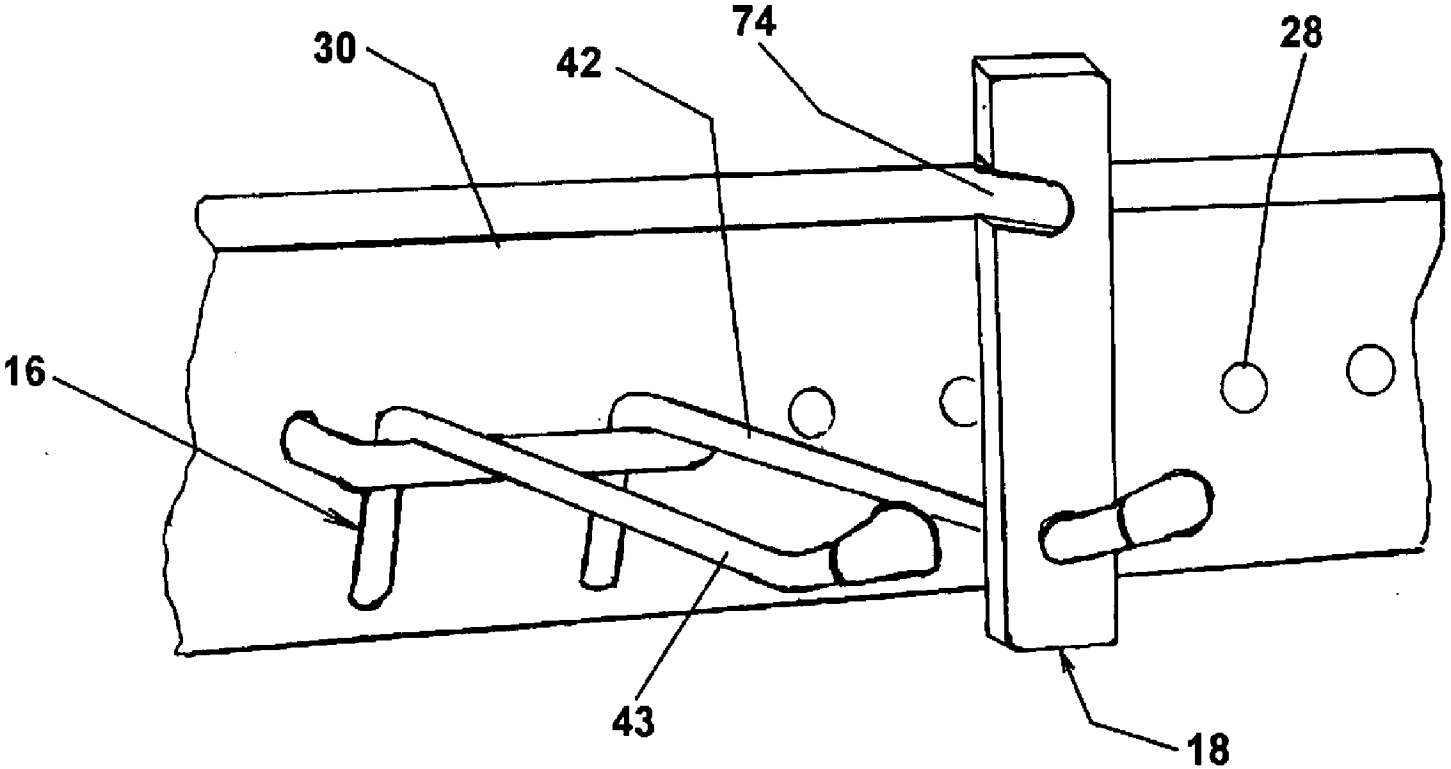
FIG. 3 is a front perspective view of the support hook with the lock bar in the raised open position.

The sidewall 80 and bottom wall 82 of the lock body 70 form a detent tab section 82 that normally engages the support arm 43 to prevent free rotation to and from the closed position. Referring to FIGS. 2 and 3, as the lock bar is pivoted from the illustrated unlatched open position of FIG. 3 to the closed latched position of FIG. 2, the tab section 82 engages the support arm 43. Thereafter, the support arm 43 is manually outwardly deflected into alignment with the slot 74 allowing final pivoting to the latched condition. To unlock the lock bar 18, the foregoing sequence is reversed. While the slot 72 is outwardly and downwardly inclined, it should be apparent that the inclination may be reversed, or eliminated if the detenting feature is not desired.

The lock bar 18 is preferably formed of heavy gage galvanized sheet and is well suited for the above tool applications. For lighter articles, alternative materials such as molded plastics may be used.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the sprit and scope of the present invention. The disclosures and description herein are intended to be illustrative and are not in any sense limiting of the invention, which is defined solely in accordance with the following claims.

What is claimed:

1. A lockable support hook for mounting on a vertical support substrate having a plurality of uniformly spaced aligned holes extending between a front surface and a rear surface, said support hook comprising: first leg members extending through a pair of said holes and having upwardly turned ends engagable with the rear surface; second leg members connected to said first leg members and having downwardly turned ends engagable with the front surface; first and second elongated support legs having a circular cross section attached in parallel horizontal spaced relation to said support legs and defining therebetween a frontal opening for receiving an article to be supported thereon; a planar rectangular lock bar of heavy gage sheet metal having a hole through said metal at one lateral end for receiving and pivotally supporting said first support leg, and a downwardly and laterally inclined slot in said lock bar defined by a base and inner and outer side walls, said slot configured for receiving said second support leg at a latched position whereat said second support leg engages said base and wherein said inner wall engages said other of said support arms to resist movement to and from said latched position, with movement to said latched position effected by laterally deflecting said other of said support arms into alignment with said slot.

2. The lockable support hook as recited in claim 1 wherein swaged tabs are formed on said one of said support arms forwardly of said lock bar for preventing said lock bar from said one of said support arms.

3. A lockable support hook of the peg-board type for mounting on a thin walled support having a plurality of uniformly spaced aligned holes, said support hook comprising: mounting means including first leg members extending through a pair of said holes and having upwardly turned ends engagable with the rear surface of said support and downwardly turned ends engagable with the front surface of said support; a pair of parallel spaced elongated support legs attached at inner ends to said mounting means and projecting outwardly normal to said support, said support arms having a circular cross section and defining therebetween a frontal opening slot for receiving an article to be supported thereon; a lock member pivotally supported on one of said support arms; a downwardly opening slot in said lock member having a semicircular base and spaced inner and outer walls merging with said base, said inner and outer walls being downwardly and outwardly inclined for receiving the other of said support arms in a latched position with said semicircular base engaging said other of said support arms in said latched position thereby closing said opening to prevent removal of the article.

4. The lockable support hook as recited in claim 3 wherein said inner wall engages said other of said support arms in movement to said latched position, with movement to said latched position effected by outwardly deflecting said other of said support arms into alignment with said slot.

* * * * *